US009618197B2

(12) United States Patent
Yamada et al.

(10) Patent No.: US 9,618,197 B2
(45) Date of Patent: Apr. 11, 2017

(54) BOILER SYSTEM

(71) Applicant: Miura Co., Ltd., Ehime (JP)

(72) Inventors: Kazuya Yamada, Ehime (JP); Tetsuji Namoto, Ehime (JP); Hidetomo Saimi, Ehime (JP)

(73) Assignee: Miura Co., Ltd., Ehime (JP)

( * ) Notice: Subject to any disclaimer, the term of this patent is extended or adjusted under 35 U.S.C. 154(b) by 0 days.

(21) Appl. No.: 14/416,546

(22) PCT Filed: Feb. 28, 2013

(86) PCT No.: PCT/JP2013/055337

§ 371 (c)(1),
(2) Date: Jan. 22, 2015

(87) PCT Pub. No.: WO2014/128977

PCT Pub. Date: Aug. 28, 2014

(65) Prior Publication Data

US 2015/0204537 A1 Jul. 23, 2015

(30) Foreign Application Priority Data

Feb. 22, 2013 (JP) ..... 2013-033262

(51) Int. Cl.
*F22B 35/00* (2006.01)

(52) U.S. Cl.
CPC ..... *F22B 35/00* (2013.01); *F22B 35/008* (2013.01)

(58) Field of Classification Search
USPC ..... 122/448.1, 448.3; 236/14
See application file for complete search history.

(56) References Cited

U.S. PATENT DOCUMENTS 2,780,206 A * 2/1957 La Rocque ..... F22B 31/04 122/448.3
3,387,589 A * 6/1968 Chan ..... F22B 35/008 122/1 R (Continued)

FOREIGN PATENT DOCUMENTS

CN 201680610 U 12/2010
CN 102313276 A 1/2012

(Continued)

OTHER PUBLICATIONS

JP07167494A—machine translation.*
JP2010043639A—machine translation.*

*Primary Examiner* — Alissa Tompkins
*Assistant Examiner* — Nathaniel Herzfeld
(74) *Attorney, Agent, or Firm* — Muncy, Geissler, Olds & Lowe, P.C.

(57) ABSTRACT

The invention improves system efficiency with no waste of heat held by a stopped boiler. A boiler system includes a boiler group having a plurality of boilers and a controller for controlling a combustion state of the boiler group. The controller includes a heat release determiner for determining whether or not the plurality of boilers includes a boiler releasing heat, a boiler increase determiner for determining, when the heat releasing boiler starts combustion and the heat releasing boiler and the other combusting boilers are combusted at equal load factors, whether or not the load factor is higher than a predetermined load factor, and an output controller for combusting the heat releasing boiler when the load factor is determined to be higher than the predetermined load factor.

5 Claims, 5 Drawing Sheets

(56) References Cited

U.S. PATENT DOCUMENTS

| | | | | | |
|---|---|---|---|---|---|
| 4,534,321 | A * | 8/1985 | Rydborn | F24D 12/02 | 122/448.3 |
| 4,598,668 | A * | 7/1986 | Bader | F22B 35/008 | 122/447 |
| 4,860,696 | A * | 8/1989 | Fujita | F22B 35/008 | 122/448.3 |
| 5,042,431 | A * | 8/1991 | Shprecher | F22B 35/008 | 122/448.3 |
| 5,172,654 | A * | 12/1992 | Christiansen | F22B 35/008 | 122/448.3 |
| 7,819,334 | B2 * | 10/2010 | Pouchak | F23N 5/00 | 122/448.1 |
| 8,888,011 | B2 | 11/2014 | Miura et al. | | |
| 2011/0162593 | A1 * | 7/2011 | Miura | F22B 35/00 | 122/448.1 |
| 2011/0238216 | A1 * | 9/2011 | Yamada | F01K 13/02 | 700/274 |
| 2012/0006285 | A1 * | 1/2012 | Miura | F01K 13/02 | 122/448.3 |

FOREIGN PATENT DOCUMENTS

| | | | |
|---|---|---|---|
| JP | 07167494 | A * | 7/1995 |
| JP | 11-132405 | A | 5/1999 |
| JP | 2002-228102 | | 8/2002 |
| JP | 2010043639 | A * | 2/2010 |
| JP | 2011-196658 | | 10/2011 |

* cited by examiner

BOILER SYSTEM

TECHNICAL FIELD

The present invention relates to a boiler system. The present invention relates more particularly to a boiler system for proportionally controlling a combustion state. This application claims a priority right on the basis of JP 2013-033262 filed on Feb. 22, 2013 in Japan and its content is incorporated herein by reference.

BACKGROUND ART

Conventionally proposed boiler systems for combusting a plurality of boilers to generate steam include a boiler system of the so-called proportional control type, for continuously increasing or decreasing a boiler combustion amount to control a steam flow.

For example, Patent Document 1 proposes a method of controlling proportional control boilers that are sectioned into three load zones including a boiler number increasing load zone, an optimum operation load zone, and a boiler number decreasing load zone. According to this method, when any of the boilers is out of the optimum operation load zone and comes into a state of combusting in the boiler number increasing load zone or the boiler number decreasing load zone, the number of the combusted boilers is increased or decreased so that the boilers are combusted in the optimum operation load zone.

PRIOR ART DOCUMENT

Patent Document

Patent Document 1: JP 11-132405 A

SUMMARY OF INVENTION

Problem to be Solved by Invention

A boiler having stopped combustion due to decrease of the number of boilers holds heat for some time after stopping combustion, and thus releases the held heat while stopping combustion. If the boiler stops combustion for a long period of time, the boiler releases the held heat to be cooled. Such a cooled boiler causes quite a large starting loss until restarting combustion.

If the number of combusted boilers is increased or decreased simply in view of efficiency of the boilers as in the control method according to Patent Document 1, a heat loss due to heat release and a starting loss due to starting combustion of a cooled boiler may deteriorate system efficiency in the entire boiler system.

Out of the boilers in a combustion stopped state, a boiler releasing held heat may be called a "heat releasing boiler" and a cooled boiler may be called a "cool boiler" hereinafter.

The present invention has been achieved in view of the above problem, and an object thereof is to provide a boiler system that does not waste heat held by a stopped boiler to improve system efficiency.

Solution to Problem

The present invention relates to a boiler system provided with a boiler group including a plurality of boilers each configured to combust at a varied load factor, and a controller for controlling a combustion state of the boiler group in accordance with a required load, wherein the controller includes a heat release determiner for determining whether or not the plurality of boilers includes a boiler releasing heat, a boiler increase determiner for determining, when the heat releasing boiler starts combustion and the heat releasing boiler and the other combusting boilers are combusted at equal load, factors, whether or not the load factor is higher than a predetermined load factor, and an output controller for combusting the heat releasing boiler when the boiler increase determiner determines that the load factor is higher than the predetermined load factor.

Preferably, the heat release determiner determines that a combustion stopped boiler is releasing heat when boiler internal pressure is higher than predetermined pressure.

Preferably, the heat release determiner determines that a combustion stopped boiler is releasing heat when a period elapsed after the boiler internal pressure becomes lower than the predetermined pressure is shorter than a first period.

Preferably, the heat release determiner determines that a combustion stopped boiler is releasing heat when boiler body temperature or boiler water temperature is higher than predetermined temperature.

Preferably, the heat release determiner determines that a combustion stopped boiler is releasing heat when a period elapsed after the boiler stops combustion is shorter than a second period.

Effect of Invention

According to the present invention, a combustion stopped boiler is caused to combust while releasing heat so as not to waste heat held by the stopped boiler. The heat releasing boiler starts combustion only when the boiler has a load factor higher than a predetermined load factor after combustion. The boiler does not stop combustion immediately upon subsequent decrease of the load factor so as not to be started and stopped repeatedly. The present invention thus achieves improvement in system efficiency of the entire boiler system.

DESCRIPTION OF EMBODIMENTS

A boiler system according to a preferred embodiment of the present invention will now be described with reference to the drawings.

Figure 1:
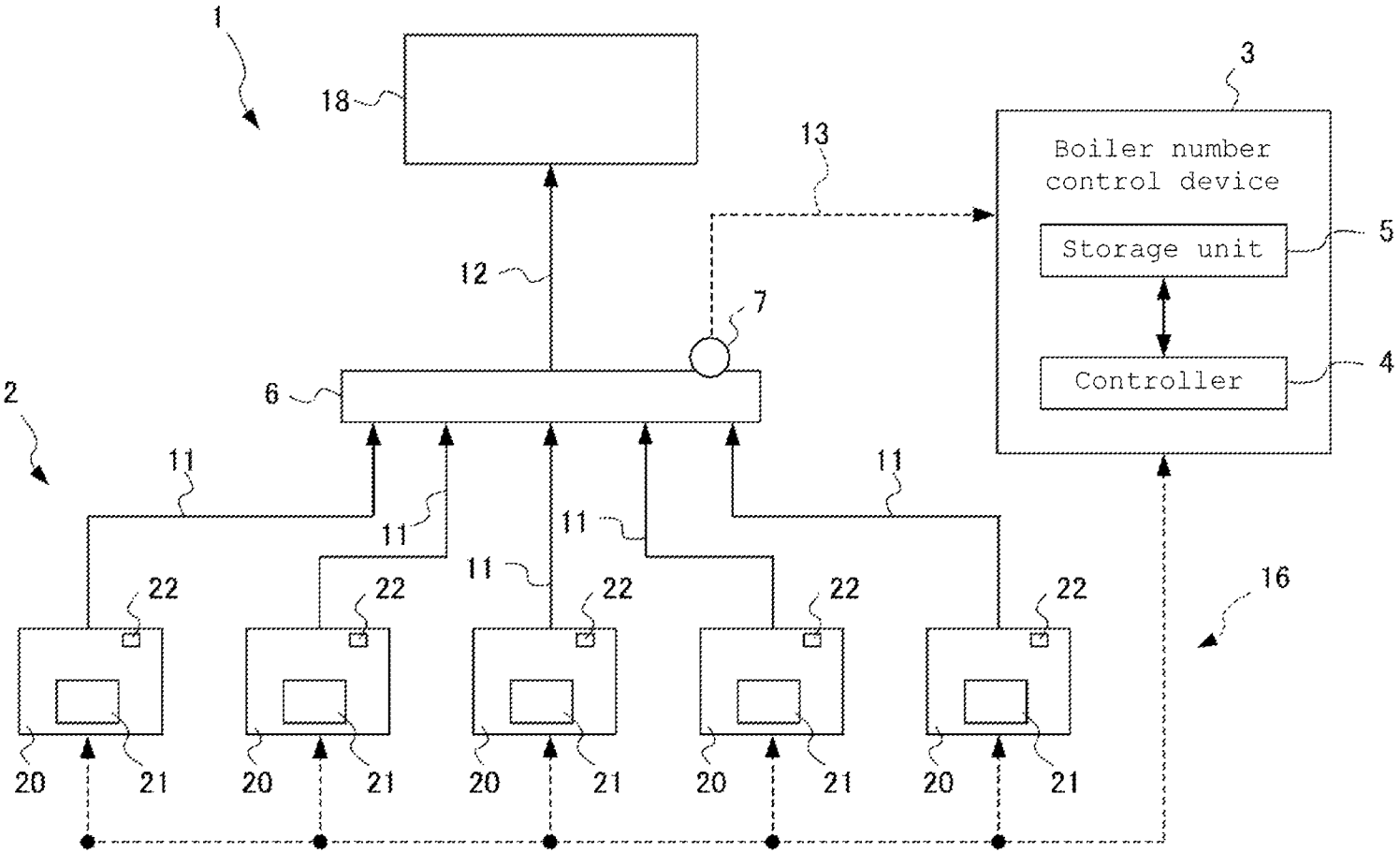
FIG. 1 is a schematic diagram of a boiler system according to an embodiment of the present invention.

A boiler system 1 according to the present invention is described initially with reference to FIG. 1.

The boiler system 1 includes a boiler group 2 having a plurality of (five) boilers 20, a steam header 6 for collecting steam generated by the plurality of boilers 20, a steam pressure sensor 7 for measuring internal pressure of the steam header 6, and a boiler number control device 3 having a controller 4 for controlling a combustion state of the boiler group 2.

The boiler group 2 includes the plurality of boilers 20 and generates steam to be supplied to a steam utilizing apparatus 18 serving as a loading machine.

Each of the boilers 20 is electrically connected to the boiler number control device 3 through a signal wire 16. The boilers 20 each include a boiler body 21 for performing combustion, and a local controller 22 for controlling a combustion state of the corresponding boiler 20.

The local controller 22 changes the combustion state of the boiler 20 in accordance with a required load. Specifically, the local controller 22 controls the combustion state of the boiler 20 in accordance with a boiler number control signal transmitted from the boiler number control device 3 through the signal wire 16. The local controller 22 also transmits a signal to be utilized by the boiler number control device 3, to the boiler number control device 3 through the signal wire 16. Examples of the signal utilized by the boiler number control device 3 include data on an actual combustion state of the boiler 20, and other data.

The steam header 6 is connected, through a steam pipe 11, to each of the boilers 20 configuring the boiler group 2. The steam header 6 has a downstream end connected to the steam utilizing apparatus 18 through a steam pipe 12.

The steam header 6 collects and stores steam generated by the boiler group 2 to regulate relative pressure differences and pressure variations of the plurality of boilers 20 and supply pressure regulated steam to the steam utilizing apparatus 18.

The steam pressure sensor 7 is electrically connected to the boiler number control device 3 through a signal wire 13. The steam pressure sensor 7 measures internal steam pressure (pressure of steam generated by the boiler group 2) of the steam header 6 and transmits a signal on the measured steam pressure (steam pressure signal) to the boiler number control device 3 through the signal wire 13.

The boiler number control device 3 controls the combustion state of each of the boilers 20 in accordance with the internal steam pressure of the steam header 6 measured by the steam pressure sensor 7. The boiler number control device 3 includes the controller 4 and a storage unit 5.

The controller 4 controls the combustion states and priority levels, which are to be described later, of the five boilers 20 by issuing various commands to the boilers 20 through the signal wire 16 and receiving various data from the boilers 20. The local controller 22 in each of the boilers 20 controls the corresponding boiler 20 in accordance with a command signal for a change of a combustion state received from the boiler number control device 3.

The storage unit 5 stores information such as the content of a command issued to each of the boilers 20 according to control of the boiler number control device 3 (controller 4) or a combustion state received from each of the boilers 20, information such as a setting condition of the combustion pattern of the boilers 20, setting information on the priority levels of the boilers 20, setting information on changes of the priority levels (rotation) and the like.

The boiler system 1 thus configured can supply steam generated by the boiler group 2 to the steam utilizing apparatus 18 through the steam header 6.

A load required at the boiler system 1 (required load) corresponds to a consumed steam flow at the steam utilizing apparatus 18. The boiler number control device 3 calculates a variation of the internal steam pressure of the steam header 6 according to a variation of the consumed steam flow from the internal steam pressure (physical quantity) of the steam header 6 measured by the steam pressure sensor 7 to control a combustion amount of each of the boilers 20 configuring the boiler group 2.

Specifically, the required load (consumed steam flow) is increased by increase of a demand from the steam utilizing apparatus 18, and the internal steam pressure of the steam header 6 is decreased by shortage of a steam flow (output steam flow to be described later) supplied to the steam header 6. In contrast, the required load (consumed steam flow) is decreased by decrease of the demand from the steam utilizing apparatus 18, and the internal steam pressure of the steam header 6 is increased by excess of the steam flow supplied to the steam header 6. The boiler system 1 can thus monitor a variation of the required load according to the variation of the steam pressure measured by the steam pressure sensor 7. The boiler system 1 calculates a necessary steam flow from the steam pressure of the steam header 6. The necessary steam flow corresponds to a steam flow needed in accordance with the consumed steam flow (required load) at the steam utilizing apparatus 18.

Figure 2:
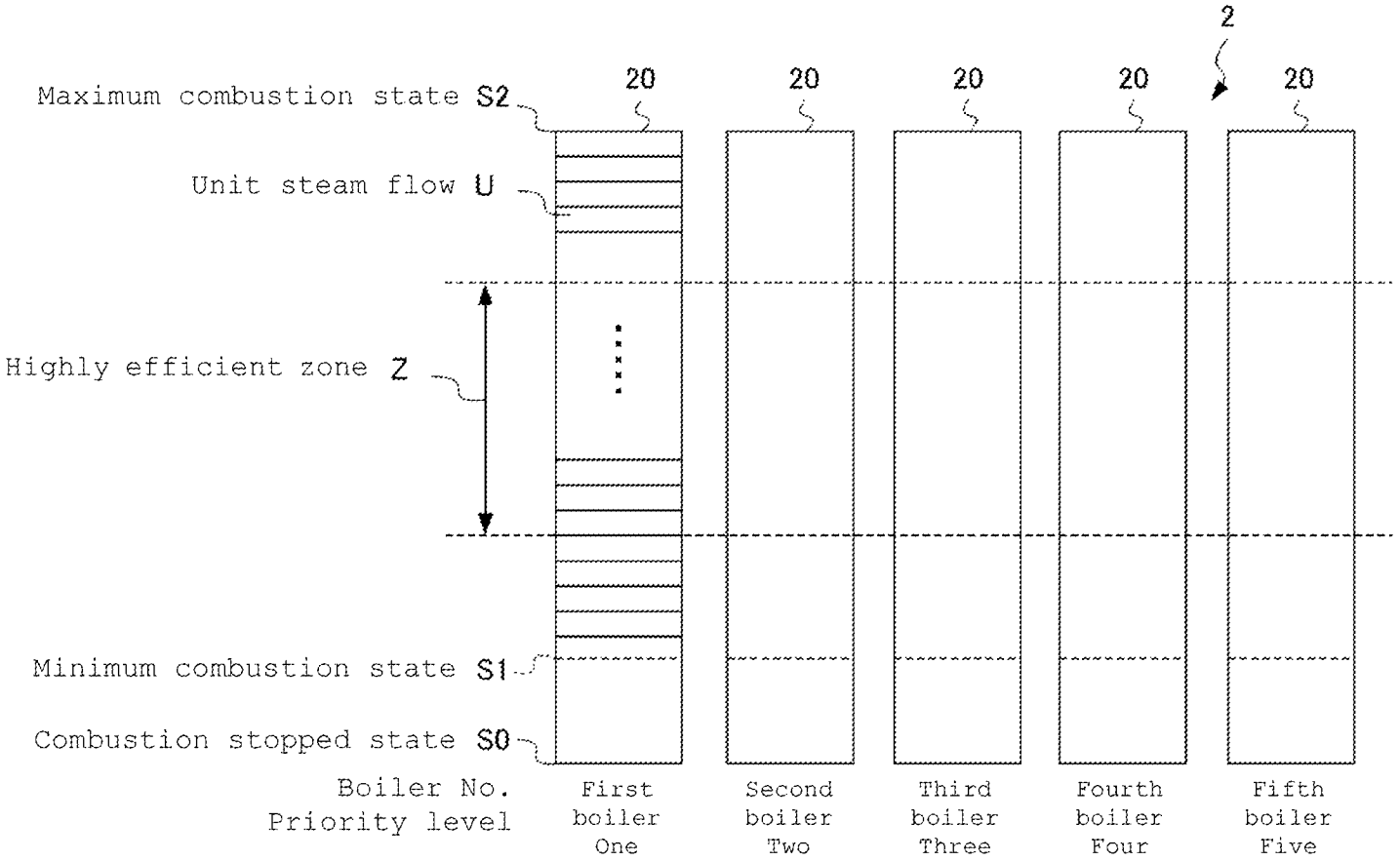
FIG. 2 is a schematic diagram of a boiler group according to an embodiment of the present invention.

The plurality of boilers 20 configuring the boiler system 1 according to the present embodiment is described below. FIG. 2 is a schematic diagram of the boiler group 2 according to the present embodiment.

The boilers 20 according to the present embodiment are configured as proportional control boilers that can each combust with a continuously changed load factor.

A proportional control boiler has a combustion amount that can be controlled continuously at least in a range from a minimum combustion state S1 (e.g. a combustion state with a combustion amount corresponding to 20% of a maximum combustion amount) to a maximum combustion state S2. The combustion amount of the proportional control boiler is regulated by control of an opening degree (combustion ratio) of a valve used for supplying fuel to a burner or a valve used for supplying combustion air.

Continuous control of a combustion amount includes a case where output from the boiler 20 (combustion amount) can be controlled actually continuously even when the local controller 22 performs calculation or utilizes a signal digitally and in a stepwise manner (e.g. when the output is controlled by the percentage.)

According to the present embodiment, a change of the combustion state between a combustion stopped state S0 and the minimum combustion state S1 of the boiler 20 as controlled by performing/stopping combustion of the boiler 20 (burner). The combustion amount can be controlled continuously in the range from the minimum combustion state S1 to the maximum combustion state S2.

More specifically, each of the boilers 20 has a unit steam flow U, which is set as the unit of a variable steam flow. The steam flow of each of the boilers 20 can be thus changed by the unit steam flow U in the range from the minimum combustion state S1 to the maximum combustion state S2.

The unit steam flow U can be set appropriately in accordance with the steam flow in the maximum combustion state S2 (maximum steam flow) of the boiler 20. In order for improvement in followability of an output steam flow to a necessary steam flow in the boiler system 1, the unit steam flow U is set preferably at 0.1% to 20% of the maximum steam flow of the boiler 20 and more preferably at 1% to 10% thereof.

An output steam flow corresponds to a steam flow outputted from the boiler group 2 and is obtained as the sum of the steam flows outputted from the plurality of boilers 20.

Each of the boilers 20 has a difference between a maximum value and a minimum value of boiler efficiency (thermal efficiency of the boiler 20) being less than a predetermined value (e.g. 3%). According to an example, the boiler 20 has the maximum boiler efficiency (about 97%) when the load factor is 50% and the minimum boiler efficiency (about 94%) when the load factor is 100%.

Each of the boilers 20 has a highly efficient zone Z corresponding to the range of the load factor where the boiler 20 combusts efficiently. The highly efficient, zone Z corresponds to the range of the load factor where boiler efficiency (thermal efficiency of the boiler 20) is higher than a certain value (e.g. 96%). This range of the load factor is most preferred for combusting the boiler 20. The highly efficient zone Z according to the present embodiment is set to the range of the load factor from 40% to 65%.

The boiler group 2 has a stop reference threshold and an increase reference threshold that are set for determination of the number of the combusted boilers 20. According to the present embodiment, the stop reference threshold corresponds to a boiler number decreasing load factor and the increase reference threshold corresponds to a varied steam flow and a load factor of a heat releasing boiler.

The boiler number decreasing load factor is a reference load factor for stopping one of the combusting boilers 20. When the load factors of the combusting boilers 20 reach (becomes equal to or lower than) the boiler number decreasing load factor, one of the combusting boilers 20 is stopped. The boiler number decreasing load factor can be set appropriately. In order to simplify the disclosure, the load factor (20%) corresponding to the minimum combustion state S1 is set as the boiler number decreasing load factor in the present embodiment.

The varied, steam flow is provided as reserve power to be briefly increased correspondingly to a sudden load variation, and is set by control of the controller 4 or manual control of an administrator in accordance with the combustion state of the boiler group 2.

As to be described later, the boiler group 2 is controlled such that a sum of reserve power of the combusting boilers 20 (a total reserve steam flow to be mentioned later) exceeds the varied steam flow. When the total reserve steam flow to be mentioned later becomes not more than (or is less than) the set varied steam flow, the stopped boiler 20 starts combustion and the number of the combusting boilers 20 is increased.

A method of determining the number of the combusting boilers 20 in accordance with a load factor of a heat releasing boiler is to be described later.

The plurality of boilers 20 has the respective priority levels. The priority levels are utilized for selection of the boiler 20 that receives a combustion command or a combustion stop command. The priority levels are each set to have an integer value such that a smaller value indicates a higher priority level. As depicted in FIG. 2, when the boilers 20 include first to fifth boilers that have the priority levels of "one" to "five", respectively, the first boiler has the highest priority level whereas the fifth boiler has the lowest priority level. These priority levels are normally controlled by the controller 4 to be described later and are changed at predetermined time intervals (e.g. every 24 hours).

The boiler group 2 thus configured has a predeterminedly set combustion pattern. According to an exemplary combustion pattern of the boiler group 2, the boiler 20 of the highest priority level is combusted and the boiler 20 of the second highest priority level is combusted when the load factor of the combusting boiler 20 exceeds a predetermined threshold.

Control by the boiler number control device 3 according to the present embodiment is described in detail below. The boiler number control device 3 according to the present embodiment is basically configured to increase the number of the combusted boilers 20 when reserve power corresponding to the varied steam flow is not secured with the combusted boilers 20. When one of the stopped boilers 20 still holds heat (heat releasing boiler) even though the reserve power corresponding to the varied steam flow is secured, the boiler number control device 3 occasionally controls to start combusting the heat releasing boiler. The load factors of the combusting boilers 20 are decreased due to starting combustion of the heat releasing boiler in this case. The heat releasing boiler can be repeatedly started and stopped depending on the correlation with the boiler number decreasing load factor.

Figure 3:
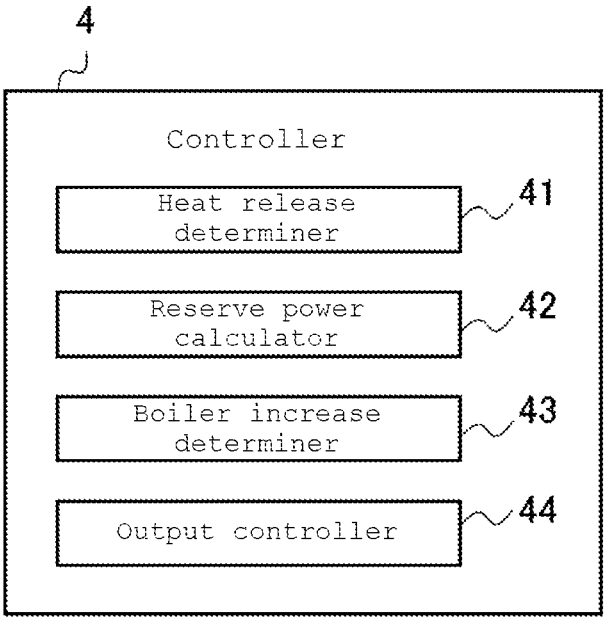
FIG. 3 is a functional block diagram depicting a configuration of a controller.

As depicted in FIG. 3, the controller 4 includes a heat release determiner 41, a reserve power calculator 42, a boiler increase determiner 43, and an output controller 44.

The heat release determiner 41 determines whether or not the combustion stopped boilers 20 include a heat releasing boiler. A heat releasing boiler can be determined by an appropriate method. In the present embodiment, a heat releasing boiler is determined in accordance with boiler internal pressure, temperature, or/and an elapsed period of the combustion stopped boiler 20.

The heat release determiner 41 determines a heat releasing boiler in the combustion stopped boilers 20 when (1) the boiler internal pressure is higher than predetermined pressure, (2) a period elapsed after the boiler internal pressure becomes lower than the predetermined pressure is shorter than a first period, (3) boiler body temperature or boiler water temperature is higher than predetermined temperature, or (4) a period elapsed after a combustion stop command is issued is shorter than a second period. Assume that boiler body temperature corresponds to temperature (surface temperature) of a water pipe of the boiler 20 and boiler water temperature corresponds to temperature of water in the water pipe of the boiler 20. The local controller 22 in the boiler 20 transmits as necessary the boiler internal pressure, the boiler body temperature, the boiler water temperature, or the elapsed period. The heat release determiner 41 can determine a heat releasing boiler by combining any of the conditions (1) to (4) or by individually applying one of the conditions.

The reserve power calculator 42 calculates, as a reserve steam flow, a difference between the maximum steam flow and a steam flow outputted from each of the combusting boilers 20 (i.e. reserve power of the corresponding boiler 20). The reserve power calculator 42 also calculates, as a total reserve steam flow, the sum of the reserve steam flows of the combusting boilers 20 (i.e. reserve power of the boiler group 2).

The boiler increase determiner 43 determines whether or not the number of the combusted boilers 20 needs to be increased. The boiler increase determiner 43 makes determination through first boiler increase determination and second boiler increase determination described below.

The first boiler increase determination is a determination method of comparing the total reserve steam flow of the plurality of combusting boilers 20 and the varied steam flow set for the boiler group 2 to increase the number of the combusted boilers 20. The boiler increase determiner 43 determines that the number of the combusted boilers 20 needs to be increased when the total reserve steam flow is less than the varied steam flow in this determination. The first boiler increase determination method by the boiler increase determiner 43 is not limited to the above but any appropriate method can be adopted alternatively.

The second boiler increase determination is made in a case where there is a heat releasing boiler. In the second boiler increase determination, whether or not to combust the heat releasing boiler is determined in accordance with the load factor of a case where the heat releasing boiler and the other combusting boilers 20 are combusted at equal load factors. The load factor of each of the combusting boilers 20 is decreased by the increase of the number of the combusted boilers 20. The second boiler increase determination utilizes the load factor that is already decreased by the increase of the number. The boiler increase determiner 43 determines to combust the heat releasing boiler when the load factor of the case where the heat releasing boiler is combusted is higher than a predetermined load factor, more particularly when the load factor is continuously higher than the predetermined load factor for a predetermined period.

The predetermined load factor can be set appropriately depending on the correlation between quantity of heat released from the heat releasing boiler and boiler efficiency deteriorated by decrease of the load factor. The predetermined load factor is set to be higher than the boiler number decreasing load factor so as to prevent a heat releasing boiler from being started and stopped repeatedly. The predetermined load factor according to the present embodiment is included in the highly efficient zone Z and is sufficiently higher than the boiler number decreasing load factor (e.g. 40%), so as to suppress decrease of boiler efficiency due to combustion of a heat releasing boiler and prevent the heat releasing boiler from being started and stopped repeatedly.

The output controller 44 causes the stopped boiler 20 to combust at the load factor equal to the load factors of the other combusting boilers 20 when the boiler increase determiner 43 determines to increase the number of the combusted boilers 20. When the first boiler increase determination results in increase of the number of the combusted boilers 20, the output controller 44 combusts the boiler 20 of the highest priority level out of the stopped boilers 20. When the second boiler increase determination results in increase of the number of the combusted boilers 20, the output controller 44 combusts the heat releasing boiler out of the stopped boilers 20.

Figure 4:
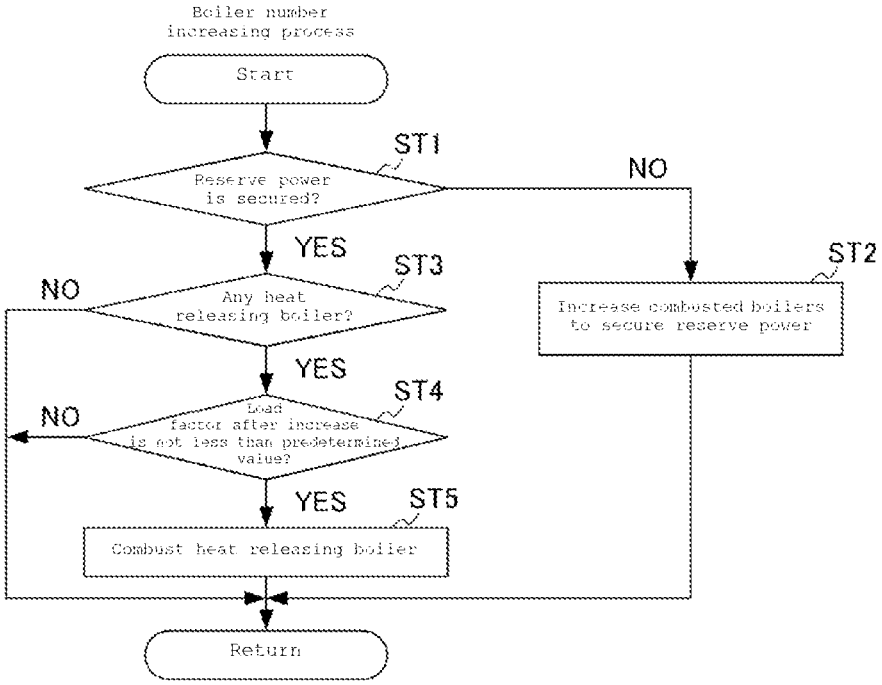
FIG. 4 is a flowchart depicting a process flow of the boiler system.

A process flow of the boiler system 1 according to the present embodiment is described next with reference to FIG. 4. FIG. 4 is a flowchart depicting a flow of a boiler number increasing process of the boiler system 1 in the case of increasing the number of the combusted boilers 20.

Initially in step ST1, the controller 4 determines whether or not reserve power is secured. Specifically, the boiler increase determiner 43 compares the total reserve steam flow calculated, by the reserve power calculator 42 and the varied steam flow set for the boiler group 2 and determines whether or not the total reserve steam flow is larger than the varied steam flow. If the total reserve steam flow is determined to be smaller than the varied steam flow in step ST1, the controller 4 (output controller 44) increases the number of the combusted boilers in accordance with the priority levels in step ST2, so as to secure reserve power corresponding to the varied steam flow. The controller 4 completes the boiler number increasing process when the process of the step ST2 ends.

In contrast, if the total reserve steam flow is larger than the varied steam flow, the controller 4 (heat release determiner 41) determines whether or not there is a heat releasing boiler in step ST3. The heat release determiner 41 determines whether or not the combustion stopped boilers 20 include a heat releasing boiler. Specifically, the heat release determiner 41 determines whether or not there is a heat releasing boiler in accordance with each or appropriate combination as necessary of the conditions (1) to (4) of the heat release determination method. If it is determined in step ST3 that there is no heat releasing boiler, the controller 4 completes the boiler number increasing process.

In contrast, if there is a heat releasing boiler, the controller 4 (boiler increase determiner 43) determines in step ST4 whether or not the load factor after the heat releasing boiler starts combustion, or the load factor decreased due to the increase of the number, is continuously higher than the predetermined load factor for the predetermined period. If it is determined that the load factor is continuously higher than the predetermined load factor for the predetermined period in step ST4, the controller 4 (output controller 44) starts combusting the heat releasing boiler (step ST5). The controller 4 (output controller 44) causes the heat releasing boiler and the already combusting boilers 20 to combust at equal load factors.

After step ST5, if it is determined that the load factor is lower than the predetermined load factor in step ST4, or if it is determined that the load factor is not continuously higher than the predetermined load factor for the predetermined period in step ST4, the controller 4 completes the boiler number increasing process.

A specific example of operation of the boiler system 1 according to the present invention is described next with reference to FIGS. 5(1) to 6(2) FIGS. 5(1) to 6(2) are views each schematically depicting a combustion state of the boiler group 2.

Figure 5:
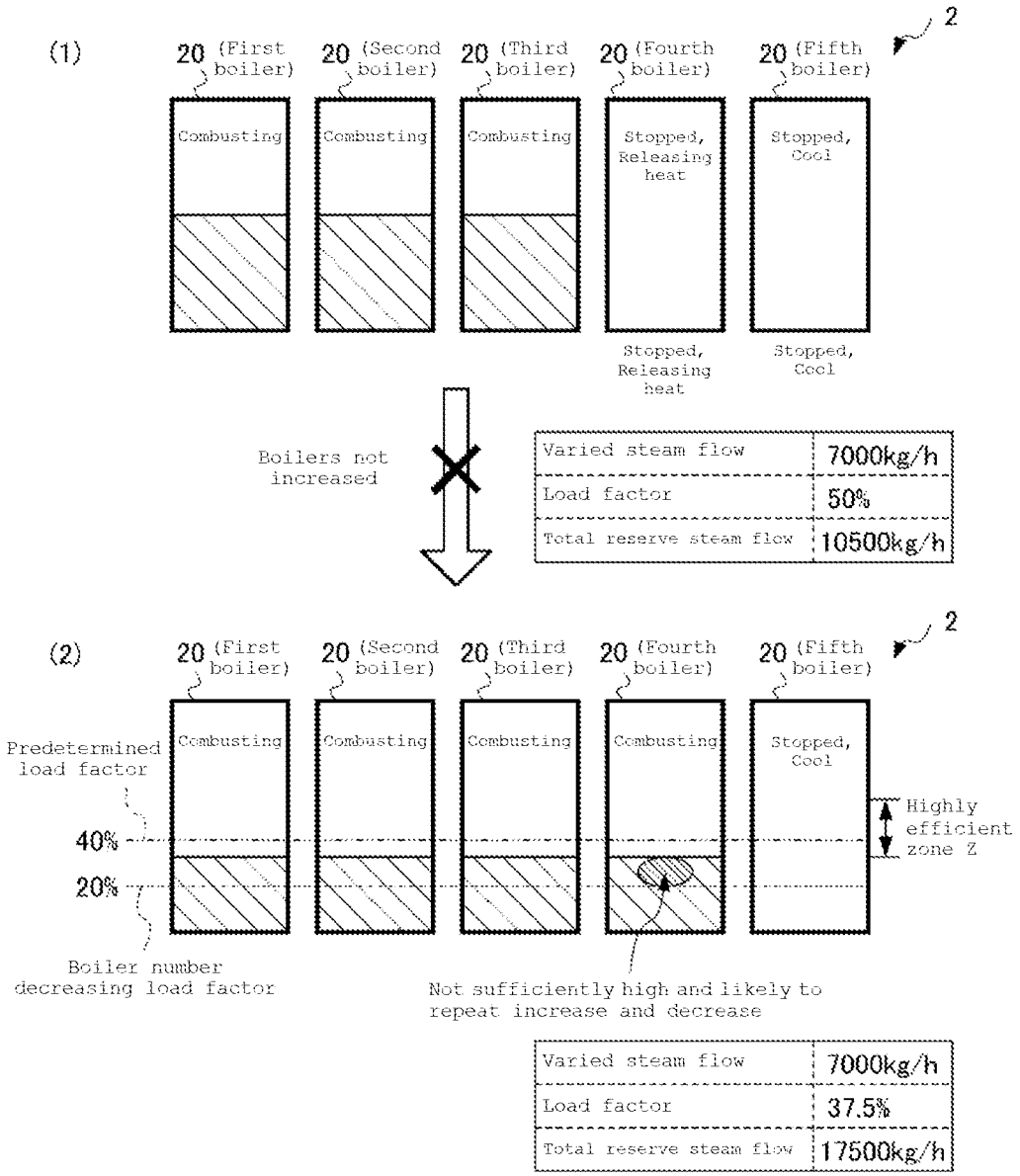
FIGS. 5(1) and 5(2) are schematic views exemplifying operation of the boiler system.

The boilers 20 in FIGS. 5(1) to 6(2) are each assumed to have the capacity of 7000 kg and its varied steam flow is equal to the steam flow of 7000 kg/h.

With reference to FIG. 5(1), the first to third boilers are each combusting at the load factor of 50%, whereas the fourth and fifth boilers are stopped. Assume that the fifth boiler is a cool boiler that is already cooled and the fourth boiler is a heat releasing boiler that still holds heat.

The first to third boilers are each combusting at the load factor of 50%, and the total reserve steam flow is thus 10500 kg/h in this case. Reserve power corresponding to the varied steam flow is secured in the state depicted in FIG. 5(1). The controller 4 (boiler increase determiner 43) accordingly makes the first boiler increase determination to find that reserve power is secured and determines that there is no need to increase the number of the combusted boilers 20 (YES in step ST1 in FIG. 4).

Regarding the fourth boiler releasing heat, the controller 4 (boiler increase determiner 43) makes the second boiler increase determination to determine whether or not the fourth boiler needs to start combustion (step ST4 in FIG. 4). The three boilers, namely the first to third boilers, are each combusting at the load factor of 50% in the state depicted in FIG. 5(1). When the fourth boiler starts combustion, the four boilers, namely the first to fourth boilers, each combust at the load factor of 37.5% as depicted in FIG. 5(2). The load factor of 37.5% is lower than the predetermined load factor (40%). In the state depicted in FIG. 5(2), the controller 4 (boiler increase determiner 43) thus determines that the fourth boiler releasing heat should not start combustion (NO in step ST4 in FIG. 4).

Subsequently with reference to FIG. 6(1), the first to third boilers are each combusting at the load factor of 60%, whereas the fourth and fifth boilers are stopped. Assume that the fifth boiler is a cool boiler that is already cooled and the fourth boiler is a heat releasing boiler that still holds heat.

Figure 6:
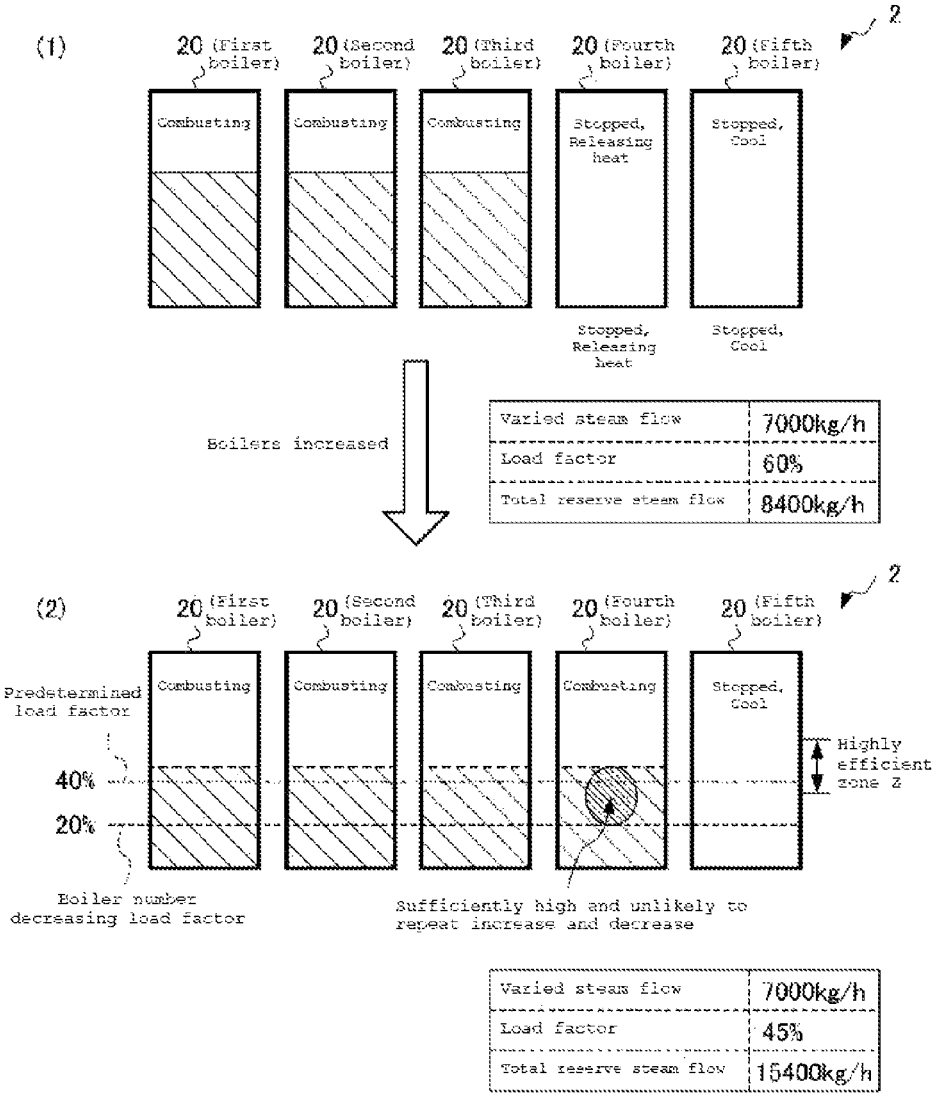
FIGS. 6(1) and 6(2) are schematic views exemplifying operation of the boiler system.

Reserve power corresponding to the varied steam flow is secured also in the state depicted in FIG. 6(1). The controller 4 (boiler increase determiner 43) accordingly makes the first boiler increase determination to find that reserve power is secured and determines that there is no need to increase the number of the combusted boilers 20 (YES in step ST1 in FIG. 4).

Regarding the fourth boiler releasing heat, the controller 4 (boiler increase determiner 43) makes the second boiler increase determination. The three boilers, namely the first to third boilers, are each combusting at the load factor of 60% in the state depicted in FIG. 6(1). When the fourth boiler starts combustion, the four boilers, namely the first to fourth boilers, each combust at the load factor of 45% as depicted in FIG. 6(2). The load factor of 45% is higher than the predetermined load factor (40%). In the state depicted in FIG. 6(2), the controller 4 (output controller 44) thus causes the fourth boiler releasing heat to start combustion to increase the number of the combusted boilers 20 (step ST5 in FIG. 4).

The boiler system 1 according to the present embodiment described above exerts the following effects.

The controller 4 makes the second boiler increase determination to determine whether or not to start combustion of a heat releasing boiler when the combustion stopped boilers 20 includes any heat releasing boiler. The second boiler increase determination is made so that the heat releasing boiler is combusted preferentially as compared to a normal case and inhibits a state where the heat releasing boiler is stopped for a long period. The heat releasing boiler can be prevented from becoming cooled, and there is thus decreased possibility of a starting loss due to starting such a cool boiler.

The number of the combusting boilers 20 is increased when the heat releasing boiler starts combustion. This leads to decrease of the load factor of each of the combusting boilers 20. The controller 4 makes the second boiler increase determination on whether or not the load factor of the case where the heat releasing boiler and the other boilers 20 are combusted at equal load factors is higher than the predetermined load factor that is sufficiently higher than the boiler number decreasing load factor. The heat releasing boiler starts combustion only when the load factor is found to be sufficiently higher than the boiler number decreasing load factor by the second boiler increase determination. The heat releasing boiler can be thus prevented from starting and stopping repeatedly. This configuration prevents deterioration in system efficiency due to starting and stopping the heat releasing boiler and achieves effective utilization of heat released from the heat releasing boiler. The entire boiler system 1 can thus achieve improved system efficiency.

The controller 4 is configured to specify a heat releasing boiler in the combustion stopped boilers 20 when the boiler internal pressure is higher than the predetermined pressure or when the period elapsed after the boiler internal pressure becomes lower than the predetermined pressure is shorter than the first period. The boiler 20 can supply steam immediately after starting combustion with a small starting loss. System efficiency can be improved on the correlation with a heat loss due to release of heat.

Normally, no steam flows from the steam header 6 into the boiler 20. When steam flows from the steam header 6 into the boiler 20 because of aging degradation or the like, whether or not the boiler releases heat may not be determined appropriately only in accordance with the boiler internal pressure.

The controller 4 can be configured to specify a heat releasing boiler in the combustion stopped boilers 20 when the boiler body temperature or the boiler water temperature is higher than the predetermined temperature or when the period elapsed after the boiler stops combustion is shorter than the second period. This configuration enables more accurate specification of a heat releasing boiler thereby to achieve improvement in system efficiency.

The boiler system 1 according to each of the preferred embodiments of the present invention is described above. The present invention is not limited to the embodiments but can be modified where appropriate.

For example, the first boiler increase determination is made by whether or not reserve power corresponding to the varied steam flow is secured in the above embodiment, although the method of the first boiler increase determination is not limited to the above. The present invention is characterized by separately making boiler increase determination for a heat releasing boiler even when the first boiler increase determination results in no need to increase the number of the combusted boilers 20. The first boiler increase determination can be made by any other appropriate method.

The plurality of boilers 20 is configured as the proportional control boilers in the above embodiments. The boilers 20 are not limited to the proportional control boilers but can be configured as stepped value control boilers stepped value control boiler has a plurality of stepped combustion points and can control a combustion amount by selectively turning on/off combustion, regulating size of a flame, or the like so as to stepwisely increase or decrease the combustion amount in accordance with a selected combustion point. According to an example, the plurality of boilers 20 can be configured as three-point boilers each having three points, namely, a combustion stopped point, a low combustion point, and a high combustion point. The boilers 20 are not limited to the three-point type but can have any N combustion points.

Furthermore, the present invention is applied to the boiler system provided with the boiler group 2 including the five boilers 20 according to the present embodiment. The present invention is not limited to this case. Specifically, the present invention is applied to a boiler system provided with a boiler group including two to four boilers or at least, six boilers.

The boilers 20 according to the present embodiment are configured as the proportional control boilers such that the change of the combustion state of the each of the boilers 20 between the combustion stopped state S0 and the minimum combustion state S1 is controlled by performing/stopping combustion of the boiler 20 and the combustion amount can be controlled continuously in the range from the minimum combustion state S1 to the maximum combustion state S2. The present invention is not limited to this case. Specifically, the boilers can be each configured as a proportional control boiler of which combustion amount can be controlled continuously in the entire range from the combustion stopped state to the maximum combustion state.

An output steam flow of the boiler group 2 corresponds to the sum of steam flows from the plurality of boilers 20 in the present embodiment. The present invention is not limited to this case. Specifically, the output steam flow of the boiler group 2 can alternatively correspond to the sum of commanded steam flows as steam flows calculated from combustion command signals transmitted from the boiler number control device 3 (controller 4) to the plurality of boilers 20.

REFERENCE SIGN LIST

1 Boiler system
2 Boiler group

20 Boiler
4 Controller
41 Heat release determiner
42 Reserve power calculator
43 Boiler increase determiner
44 Output controller
U Unit steam flow

The invention claimed is:

1. A boiler system comprising a boiler group including at least three boilers each configured to combust at a varied load factor which represents a rate of an amount of combustion with respect to a maximum amount of combustion of a boiler, and a controller for controlling a combustion state of the boiler group in accordance with an amount of steam required by a user apparatus, wherein the controller includes a determiner for determining a heat releasing boiler configured to determine that a heat releasing boiler exists among the plurality of boilers, the heat releasing boiler being at rest and releasing heat obtained during the heat releasing boiler having been in combustion, a boiler increase determiner configured to determine whether or not a load factor, at which the heat releasing boiler resumes combustion and other boilers in combustion continue combustion, such that a first total amount of steam supplied by the heat releasing boiler after resumption of combustion and the other boilers in combustion is the same as a second total amount of steam having been supplied by the other boilers in combustion prior to the resumption of combustion of the heat releasing boiler, is higher than a predetermined load factor value, and an output controller configured to cause the heat releasing boiler to resume combustion when the determiner determines that the heat releasing boiler exists among the plurality of boilers even if the other boilers in combustion maintain a margin in excess of reserve power corresponding to a varied steam flow which allows the other boilers to briefly increase an output of steam in response to a sudden load variation and the boiler increase determiner determines that the load factor is higher than the predetermined load factor value, wherein the predetermined load factor value of each of the plurality of boilers is configured to fall in a highly efficient zone corresponding to a range where each of the plurality of boilers combusts efficiently, and to be a predetermined amount higher than a boiler number decreasing load factor which is used as a stop reference threshold according to which the controller determines whether to stop each of the plurality of boilers.

2. The boiler system according to claim 1, wherein the determiner for determining a heat releasing boiler determines that a combustion stopped boiler is the heat releasing boiler when an internal pressure of the combustion stopped boiler is higher than a predetermined pressure.

3. The boiler system according to claim 1, wherein the determiner for determining a heat releasing boiler determines that a combustion stopped boiler is the heat releasing boiler when a period of elapsed time during which an internal pressure of the combustion stopped boiler becomes lower than a predetermined pressure is shorter than a first amount of time.

4. The boiler system according to claim 1, wherein the determiner for determining a heat releasing boiler determines that a combustion stopped boiler is the heat releasing boiler when a body temperature or a water temperature of the combustion stopped boiler is higher than a predetermined temperature.

5. The boiler system according to claim 1, wherein the determiner for determining a heat releasing boiler determines that a combustion stopped boiler is the heat releasing boiler when a period of elapsed time during which the combustion stopped boiler has stopped combustion is shorter than a second amount of time.

* * * * *